US007169063B2

(12) United States Patent
Tuttle

(10) Patent No.: US 7,169,063 B2
(45) Date of Patent: Jan. 30, 2007

(54) GOLF CLUB HOSEL REINFORCEMENT BRIDGE

(75) Inventor: Jeffrey John-Carl Tuttle, Sterling Heights, MI (US)

(73) Assignee: Jeffrey J. Tuttle, Sterling Heights, MI (US)

( * ) Notice: Subject to any disclaimer, the term of this patent is extended or adjusted under 35 U.S.C. 154(b) by 0 days.

(21) Appl. No.: 10/811,052

(22) Filed: Mar. 29, 2004

(65) Prior Publication Data

US 2005/0215344 A1 Sep. 29, 2005

(51) Int. Cl.
*A63B 53/04* (2006.01)

(52) U.S. Cl. ..... 473/345

(58) Field of Classification Search ..... 473/327–328, 473/336–337, 332, 339, 324, 345, 349–350
See application file for complete search history.

(56) References Cited

U.S. PATENT DOCUMENTS

| | | | | |
|---|---|---|---|---|
| D382,613 | S * | 8/1997 | Devendorf | D21/739 |
| 5,695,409 | A * | 12/1997 | Jackson | 473/305 |
| 6,431,995 | B1 * | 8/2002 | Jackson | 473/305 |
| 6,824,474 | B1 * | 11/2004 | Thill | 473/327 |
| 2001/0027139 | A1 * | 10/2001 | Saso | 473/327 |

* cited by examiner

*Primary Examiner*—Stephen Blau

(57) ABSTRACT

The method of design of a golf club with a hosel reinforcement bridge is disclosed. This reinforcement bridge helps stabilize the golf club at impact; preventing miss hits from the twisting of the club head.

2 Claims, 4 Drawing Sheets

GOLF CLUB HOSEL REINFORCEMENT BRIDGE

BACKGROUND OF THE INVENTION

A golf club hosel reinforcement bridge is used to minimize turning of the golf club head at impact with a golf ball and thus minimize the detrimental effects of said club head turning in the golf shot. The method of designing such a bridge is disclosed herein.

SUMMARY OF THE INVENTION

Certain golfers have a swing trait that is referred to herein as an "open chest" at impact. This swing trait is very common with both women and with exceptionally powerful golfers, but can occur in varying degrees with any golfer. The current design of golf clubs can help accommodate many swing styles or swing traits, but this open chest condition is not one which has been successfully addressed. Normally a golfer with an open chest at impact will be prone to miss hitting the ball by both pulling it (miss hit to the left with a right handed golfer) and pushing it (miss hit to the right with a right handed golfer), often with the golf head turning at impact. Through the use of a hosel reinforcement bridge between the hosel and either the upper surface of the club for a wood, or between the hosel and heel of the golf club for irons or putters, an improved golf club can be designed that will minimize the detrimental shot effects caused by this open chest swing trait. Further, this design improvement will also make a golf club more universal by allowing it to be used by those with a greater variety of chest positions in their golf swing.

DETAILED DESCRIPTION OF THE INVENTION

I. Chest Position Swing Trait

Figure 1:
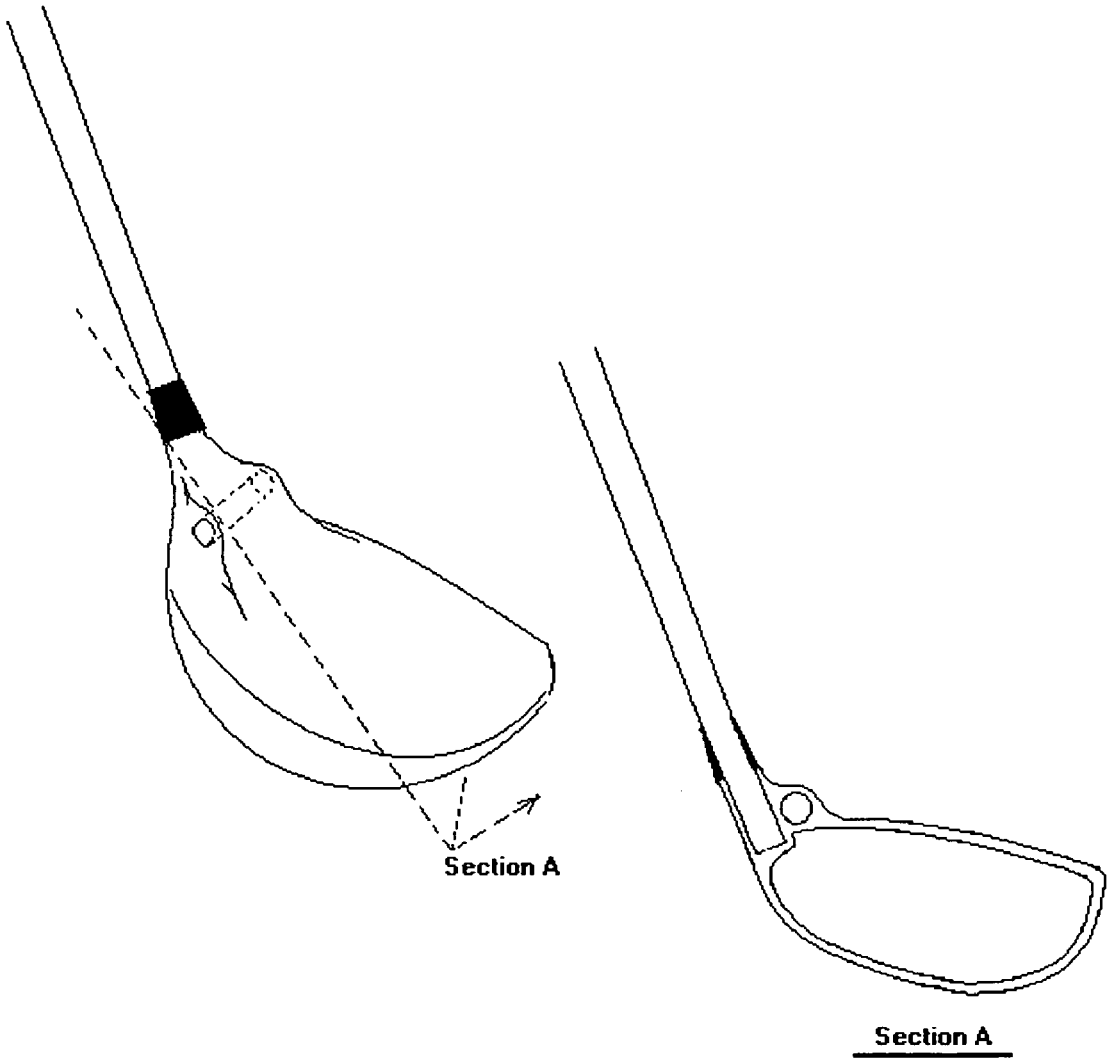
FIG. 1 depicts a typical design of a hosel reinforcement bridge in a golf club wood with an isometric and cross sectional view.

Each golfer has a unique body structure and body balance. This can lead to a variety of golf swing styles or golf swing traits. One swing trait that can be observed is how in or out a golfers chest is pushed at impact. When designing a golf club the shape of the club can be varied to better accommodate an in or out chest position. For example, a longer, more half pear shaped wood club head is better suited to a golfer who pushes his or her chest out at impact, where as a more symmetrical half sphere shape is better suited to golfer who pushes his or her chest in at impact. However, some golfers have an open chest at impact. An open chest is best described as having both an in and out pushing of the chest at impact. Thus, as the shock of impact with the golf ball is transferred to this open chest golfer, the golfer's chest will collapse a very outward or very inward position, and instantaneously the golfers club shape can be either too half pear shaped or too half sphere shaped for impact with this instantaneous chest position. Thus, for a golf club to work well for an open chest golfer, the golf club must be designed to handle a large variation of chest positions at impact, so that as a golfer's chest position changes instantaneously at impact with the golf ball, the golf club can still produce a generally straight ball flight in the generally intended direction. Also, a golf club that is designed to handle a large variation of chest positions at impact would also be a more universal golf club since it can accommodate a greater variety of normal chest positions at impact. Through the use of a hosel reinforcement bridge as described herein, a golf club that can accommodate a large variation of chest positions at impact can be designed.

II. Golf Club Hosel Reinforcement Bridge Design Principles

The application of force during a golf swing must be transferred through the golf shaft, into the golf club hosel, and through the golf club head into the golf ball. During a swing when a golfers chest position is pushed too in or out, the application of force through the golf hosel is considered non-optimal, causing a movement or rotation of the golf head generally at impact that leads to a golf shot other than what was intended. This non-optimal application of force through the hosel can be transmitted through a hosel bridge to create a partially compensating force in the golf club head. For example, a weak counterclockwise rotation of the hands in a right-handed golfers swing will allow the club face to open, resulting in a rightward shot. However, this force application error will also cause an unusual area of stress in the golf club hosel. An appropriately designed reinforcement bridge will allow this unusual stress in the golf club hosel to transmit to the far or outward edge of the golf club, creating more firmness on that edge when striking the golf ball, in effect creating a pulling reaction on the ball, partially compensating for the open clubface to make a more straight ball flight. Similarly, a different portion of the same hosel bridge can transmit a force application error in a golf club hosel that would normally cause a pulled shot (leftward pull for a right handed golfer) into a firmness on the inward side of the golf club to create a rightward pushing reaction on the golf ball, partially compensating for the closed face of the club head to make a more straight ball flight.

III. Typical Design of a Golf Club Hosel Reinforcement Bridge

Through trials it has been determined that the critical design consideration for a golf club hosel reinforcement bridge is the open area beneath the bridge. Design criteria for a typical open area beneath the bridge and the bridge itself will be given followed by further design considerations that would demonstrate how to tailor the design of the bridge to a specific golfers swing.

The area underneath the bridge will create a hollow cylindrical open space with a centerline that is generally a horizontal line pointed toward the target regardless of the loft of the club. A normal diameter for the hollow cylinder would be 8 mm. The typical position of this hollow cylinder for a wood type golf club would be tangent to the hosel on the toe side of the club, with a centerline approximately 8 mm up the hosel from the top surface of the face of the club. The length of this hollow would be 30 mm with the forward edge of the hollow even with the top of the face of the club. The typical position of this hollow cylinder for an iron type golf club would be tangent to the hosel on the heel side of the club, with a centerline approximately 30 mm up the hosel from the top surface of the face of the club. The length of this hollow would be equal to the width of the hosel plus 2 mm, with the forward edge of the hollow even with the bottom of the face of the club. The typical position of this hollow cylinder for putter type golf club would be tangent to the hosel on the heel side of the club, and approximately 10 mm up the hosel from the top surface of the face of the club. The length of this hollow would range from the width of the hosel, up to 30 mm depending on what the fore/aft length of the putter is. Thus, a putter that is as long fore/aft as a wood would have a similar hollow cylinder size as a wood whereas a more traditional blade putter would have a hollow cylinder only as wide as the putter hosel. The bridge of material that surrounds the hollow cylinder will have approximately a 45-degree ramp angle on either side, the transitions from the ramp to the hosel or from the ramp to the club should have a generous radius, at least 3 mm. The hosel bridge itself must have enough structure above the hollow cylinder to absorb the stresses that are transferred through it. If the material used to create the hosel bridge is structurally sound, such as titanium, the bridge could have a thickness as little as 2–3 mm.

Figure 2:
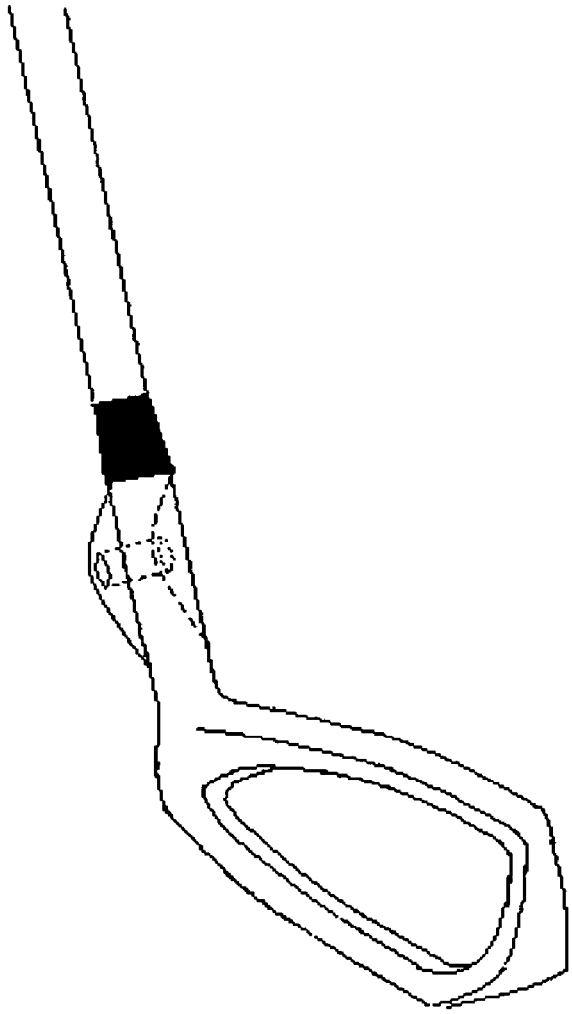
FIG. 2 depicts a typical design of a hosel reinforcement bridge used in a golf club iron with an isometric view.
Figure 3:
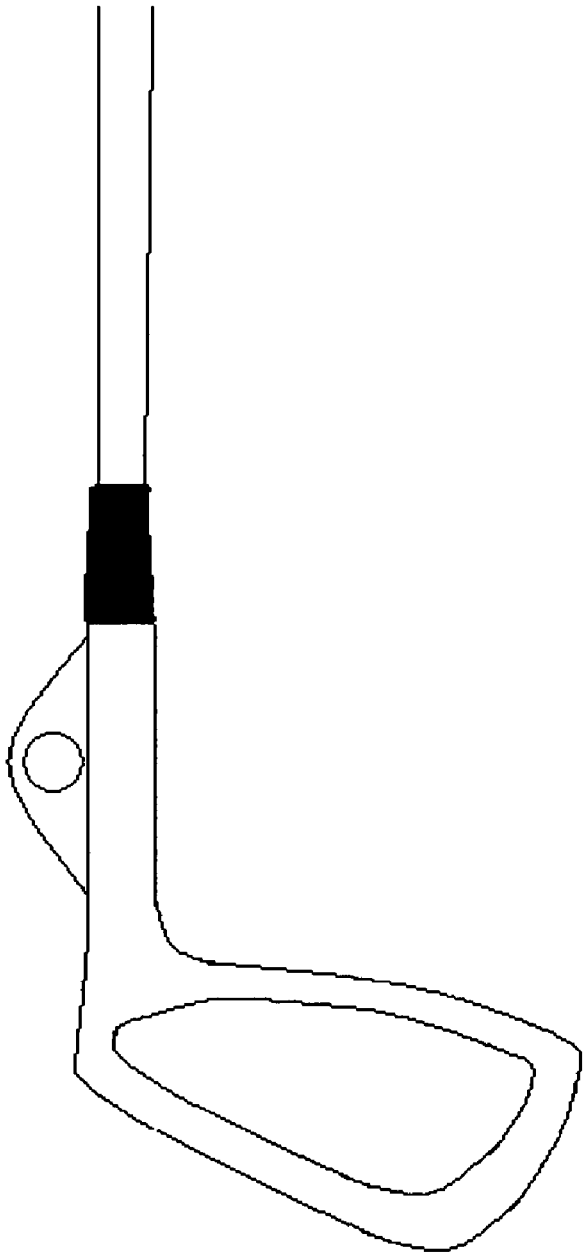
FIG. 3 depicts a typical design of a hosel reinforcement bridge used in a golf club iron with a side view.
Figure 4:
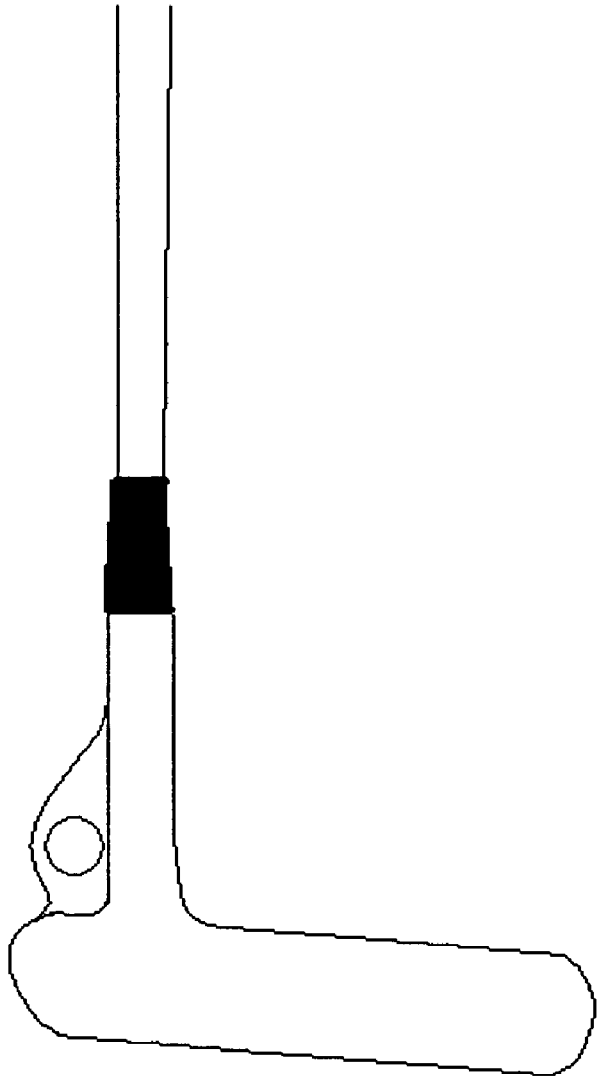
FIG. 4 depicts a typical design of a hosel reinforcement bridge used in a golf club putter with a side view.

These configurations on a golf club wood are shown on FIG. 1, on a golf club iron on FIGS. 2 and 3, and on a golf club putter on FIG. 4.

Note that the critical components of a golf club bridge are the size and shape of the hollow and the reinforcement bridge on top of it. If the inside of the hollow is filled with a material less structurally rigid than that of the bridge material, the force would still be transmitted through the more structurally rigid material, that of the bridge itself, in effect that type of structure would still be a hosel bridge as described herein. Similarly, if the ends of the hollow area are sealed with a material that is structurally rigid but is extremely thin, then the material on the ends would divert very little stress from the hosel bridge, and the design would also still be a hosel bridge as described herein. Further, it should be noted that while the optimal shape of the hollow beneath the reinforcement bridge is a cylinder (or a slightly conical cylinder as will be described in section IV), a shape that is very nearly a cylinder would still have some effect. For example, if the cylinder had small grooves running the down the face of it, it would have little effect on the way that they stress was transmitted through the bridge and around the hollow. Similarly, if one side of the cylinder were squared off, it would decrease the effectiveness of the hosel bridge, creating less compensating effect for some chest positions, but it would not be completely ineffective.

IV. Design of a Golf Club Hosel Reinforcement Bridge Tailored to a Particular Swing The following design considerations can be used in the tailoring of the golf club hosel reinforcement bridge and the hollow space created beneath it to a particular golfer's swing:

1) The larger the cylindrical or conical hollow space created, the greater the range of chest positions that will be compensated for, but the less compensating effect of the bridge and the more weight added to the club by a bigger bridge. Thus, if a golfer has only a little variation in chest position or only a little of an open chest at impact, the hollow size could be decreased from the standard 8 mm, or conversely if they have a large amount of variation in chest position or a large amount of open chest at impact, the hollow size could be increased from the standard 8 mm. A typical range would be from 3–15 mm of hollow cylinder diameter.
2) The weaker a golfer's grip (hands rotated to the left for a right handed golfer), the more the position of the hollow can be moved upward on the club. The stronger a golfer's grip (hands rotated to the left for a right handed golfer), the more the position of the hollow cylinder can be moved downward on the club. A typical adjustment could be up to +/−5 mm from those previously given.
3) If a golfer tends to hit very high shots, the hollow cylinder can be tilted so that the centerline is pointed higher than the horizontal line to the target. If a golfer tends to hit very low shots, the hollow cylinder can be tilted so that the centerline is pointed lower than the horizontal line to the target. A typical adjustment would be up to +/−8 degrees from the horizontal line to the target.
4) If a golfer tends to hit a hook, the hollow cylinder can be tilted so that the centerline is pointed farther outward than the horizontal line to the target. If a golfer tends to hit a slice, the hollow cylinder can be tilted so that the centerline is pointed farther inward than the horizontal line to the target. A typical adjustment would be up to +/−5 degrees from the horizontal line to the target.
5) If a golfer tends to lead their swing with a very aggressive hip and shoulder turn, the hollow cylinder can be larger on the end closest to the target, creating a conical shape. If a golfer tends to lead their swing with a very non-aggressive hip and shoulder turn, the hollow cylinder can be larger on the end furthest from the target, again creating a slightly conical shape. A typical adjustment would be to have a large side diameter up to 4 mm larger than the small side diameter. An extreme adjustment would be to have a large side diameter from 5–10 mm larger than the small side diameter.

The invention claimed is:

1. A golf club head, said club head further including a hosel extending generally upwardly from the heel end thereof and defining a generally upwardly open hosel bore, said hosel having at least one reinforcement bridge of material extending out from the hosel to a main portion of the head, creating a roughly cylindrical space underneath the reinforcement bridge of either no material or a less structurally sound material than that of the reinforcement bridge, wherein said club head comprises a wood-type club head in which the hosel reinforcement bridge extends from the hosel to a substantially flat upper surface of the club head, wherein said bridge forms a protrusion from said substantially flat upper surface with at least a portion of said space extending higher than said substantially flat upper surface near said hosel.

2. A golf club, having a club head further including a hosel extending generally upwardly from the heel end thereof and defining a generally upwardly open hosel bore, said hosel having at least one reinforcement bridge of material extending out from the hosel to a main portion of the head, creating a roughly cylindrical space underneath the reinforcement bridge of either no material or a less structurally sound material than that of the reinforcement bridge, wherein said club head comprises a wood-type club head in which the hosel reinforcement bridge extends from the hosel to a substantially flat upper surface of the club head, wherein said bridge forms a protrusion from said substantially flat upper surface with at least a portion of said space extending higher than said substantially flat upper surface near said hosel.

* * * * *